US006821043B2

(12) United States Patent
Teh

(10) Patent No.: US 6,821,043 B2
(45) Date of Patent: Nov. 23, 2004

(54) SURGICAL SCRUB BRUSH

(76) Inventor: Liat Wei Teh, 190 Bishan Street 13 #05-429, Singapore (SG), 570190

( * ) Notice: Subject to any disclaimer, the term of this patent is extended or adjusted under 35 U.S.C. 154(b) by 0 days.

(21) Appl. No.: 10/240,349

(22) PCT Filed: Apr. 24, 2001

(86) PCT No.: PCT/SG01/00069

§ 371 (c)(1),
(2), (4) Date: Oct. 1, 2002

(87) PCT Pub. No.: WO01/82743

PCT Pub. Date: Nov. 8, 2001

(65) Prior Publication Data

US 2003/0156884 A1 Aug. 21, 2003

(30) Foreign Application Priority Data

May 2, 2000 (SG) ..... 200002366

(51) Int. Cl.[7] ..... A46B 11/00; A46B 15/00

(52) U.S. Cl. ..... 401/39; 401/9; 401/7; 401/268; 401/282

(58) Field of Search ..... 401/7, 282, 270, 401/269, 268, 23, 24, 9, 11, 39, 37, 205, 132, 133; 15/104.94, 114, 160, 167.3, 187

(56) References Cited

U.S. PATENT DOCUMENTS

| | | | | | |
|---|---|---|---|---|---|
| 3,704,072 | A | * | 11/1972 | Kaufman | 401/291 |
| 3,966,335 | A | * | 6/1976 | Abramson | 401/10 |
| 4,181,446 | A | * | 1/1980 | Kaufman | 401/9 |
| 4,730,949 | A | * | 3/1988 | Wilson | 401/132 |
| 5,312,197 | A | * | 5/1994 | Abramson | 401/6 |
| 5,366,310 | A | * | 11/1994 | Armelles Flors | 401/132 |
| 5,375,287 | A | * | 12/1994 | Dillahunt | 15/160 |
| 5,442,829 | A | * | 8/1995 | Summers | 15/106 |
| 5,599,126 | A | * | 2/1997 | Hough | 401/184 |

* cited by examiner

*Primary Examiner*—David J. Walczak
(74) *Attorney, Agent, or Firm*—Lawrence Y. D. Ho & Associates

(57) ABSTRACT

A surgical scrub brush that contains a base with a narrow scrubbing head (50) extending therefrom. The base contains two sides, the first provided with bristles (52) extending outwards to form a brush, the second preferably provided with an absorbent material (60). The narrow scrubbing head (50) is provided for the effective scrubbing of the interdigital areas and web spaces of the band, and includes a dome (58). In the preferred embodiment, a shallow, rod-shaped depression (56) is further provided on the bristle profile on the main body to assume the approximate shape of one side of a finger such that the user can scrub his/her fingers effectively.

16 Claims, 7 Drawing Sheets

SURGICAL SCRUB BRUSH

FIELD OF THE INVENTION

The present invention relates to brushes in general. In particular, the present invention relates to brushes for scrubbing hands before surgical operations.

BACKGROUND

Surgical scrub brushes are typically used to decrease the amount of microorganisms and contaminating material from a surgeon's hands by providing a tool for mechanically scrubbing the skin. Very often antiseptic chemicals are also used to reduce skin contaminants to a minimum. Therefore, prior to surgery, it is a prerequisite for surgeons to scrub their hands and forearms. The process would usually require a disposable, sterile and firm bristle scrub brush to physically and thoroughly remove dirt, grease and other particles that adhere to the fingers, finger nails 22, inter-digital areas 24, web spaces 26 and crevices 28 of the hands and forearms as shown in FIGS. 1A and 1B. Some brushes are also provided with a sponge for the administration of antiseptic disinfectants. The sponge is typically impregnated with a disinfectant by the manufacturer, such that the user can just apply the disinfectant directly to the skin. The complete cleansing technique typically takes ten minutes.

FIGS. 2A and 2B show a conventional bristle brush with a sponge top. The conventional bristle brush 30 is molded as a rectangular piece, having a rectangular base 31, and uniform straight edges 32 on two opposing sides for hand-gripping. A rectangular sponge 34 is provided on one side of the base 31, and straight bristles extend from the other side of the base. Base 31 is also provided with slits 36 that that run along the center. This allows detergent solution that is typically impregnated into the sponge to flow from the sponge side to the bristle side.

It is clear, however, that the hand has many areas that are not easily scrubbed by a rectangular-shaped scrub. U.S. Pat. No. 4,181,446 describes a bendable brush such that bristles on one side may be swung onto oppositely extending sides for brushing engagement with an internal or concave surface. The bended surface, however, creates a large distance between the brushing ends of the bristles located thereon, and thus reduces the effective brushing surface exactly at the position where brushing is most needed. Furthermore, impregnating the sponge with a cleaning agent also causes the chemical and mechanical weakening of the sponge, and typically limits the storage life of the brush.

There is therefore a need to provide a improved scrub brush that addresses the limitations in the prior art.

SUMMARY OF THE INVENTION

Accordingly, the present invention provides, a scrub brush that contains a base with a narrow scrubbing head extending therefrom. The base contains two sides. The first side is provided with bristles extending outwards to form a brush. The second side is preferably provided with an absorbent material mounted thereon. The shape of the base is defined by a front edge, a back edge and two lateral edges therebetween. The front edge is formed into an elongated and pointed extension such that bristles positioned thereon form the scrubbing head while the bristles between the lateral edges form the main body. The scrubbing head contains a distal end and a proximal end, with the proximal end connected to the main body. The narrow scrubbing head is provided for the effective scrubbing of the interdigital areas and web spaces.

In the preferred embodiment, the ends of the bristles are formed into a contoured profile for the effective cleaning of various difficult-to-clean areas. The base is preferably made of a rigid plastic, with the bristle side of the base curved outwards to form a convex profile such that the ends of the bristles on the main body form a corresponding curved surface. In the preferred embodiment, a shallow, rod-shaped depression is further provided on the bristle profile on the main body. This depression assumes the approximate shape of one side of a finger such that the user can scrub his/her fingers effectively. In another preferred embodiment, the bristles at the distal end of the scrubbing head are longer than those positioned at the proximal end.

DESCRIPTION OF THE INVENTION

The following detailed description describes the preferred embodiment for implementing the underlying principles of the present invention. One skilled in the art should understand, however, that the following description is meant to be illustrative of the present invention, and should not be construed as limiting the principles discussed herein. In the following discussion, and in the claims the terms "including", "having" and "comprising" are used in an open-ended fashion, and thus should be interpreted to mean "including but not limited to . . . ".

Figure 1A:
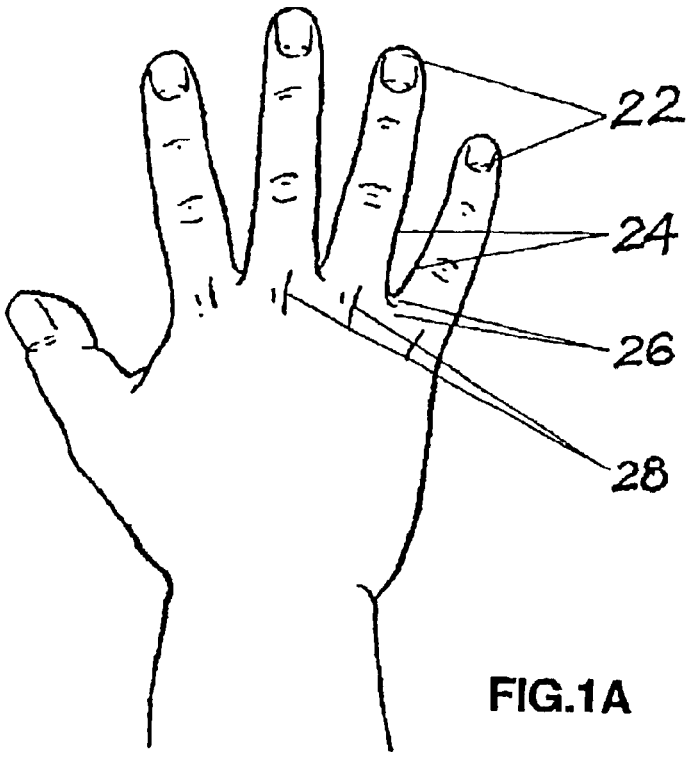
FIGS. 1A and 1B show the dorsal and palmer surfaces of a hand respectively.
Figure 1B:
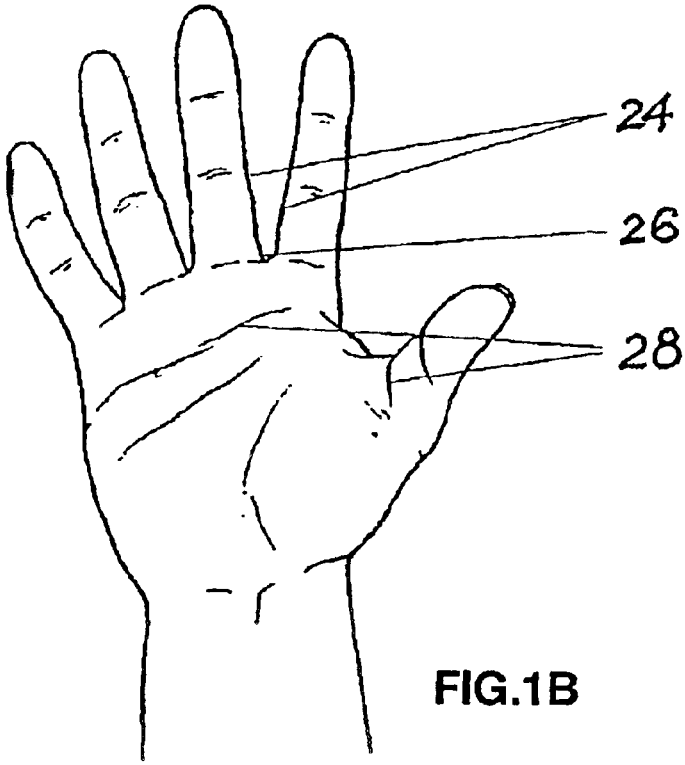
Figure 2A:
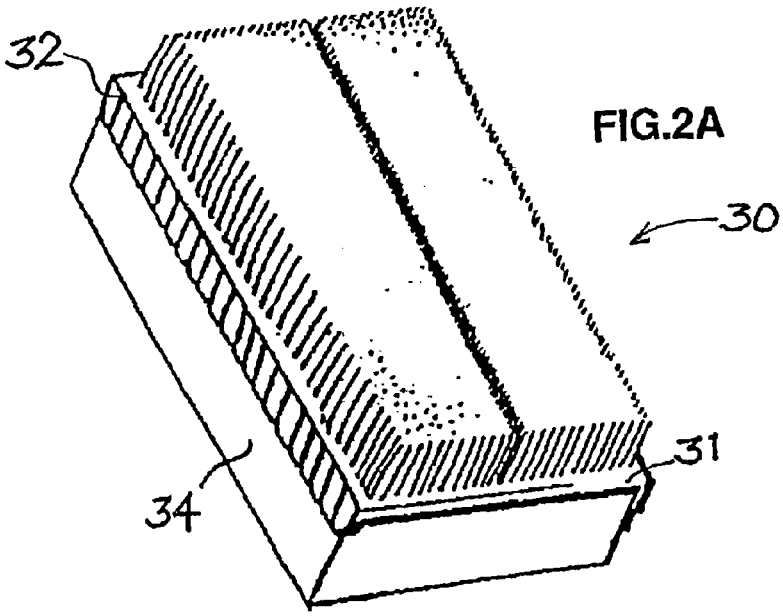
FIGS. 2A–2F show the perspective view (FIG. 2A); top plan view (without sponge) (FIG. 2B); bottom plan view (FIG. 2C); end view (FIG. 2D); side view (FIG. 2E) and top plan view (with sponge) (FIG. 2F) of a prior art brush.
Figure 2B:
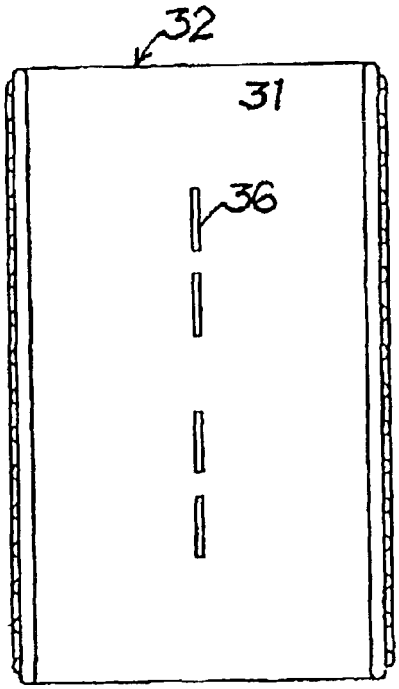
Figure 2C:
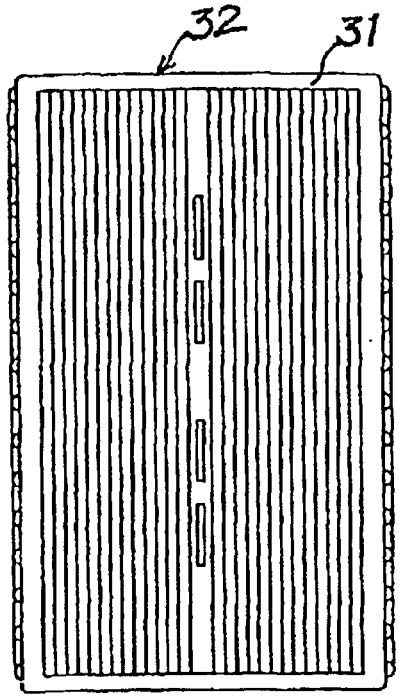
FIG.2 C (PRIOR ART)
Figure 2D:
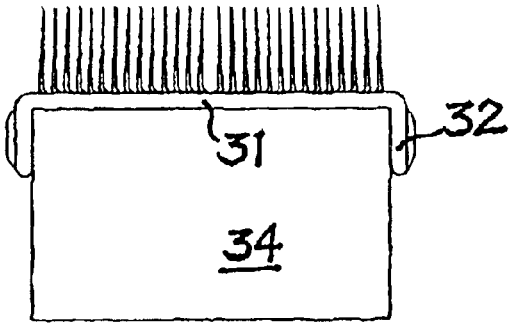
Figure 2E:
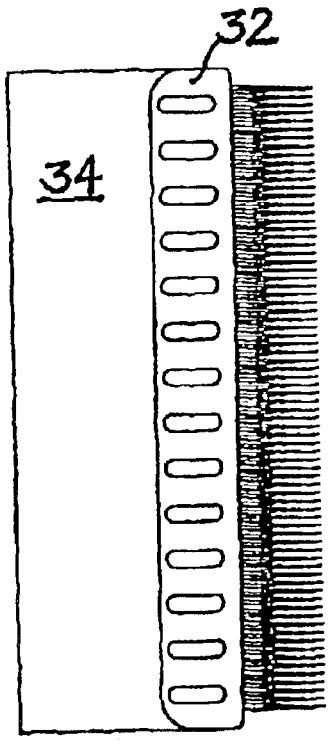
Figure 2F:
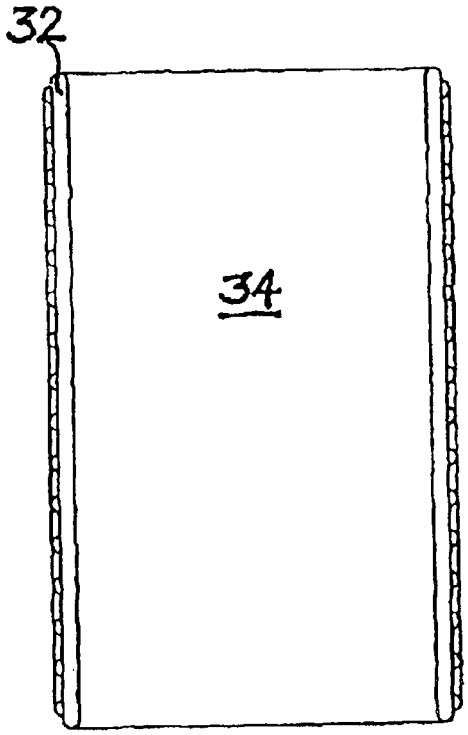
FIG.2 F (PRIOR ART)
Figure 3A:
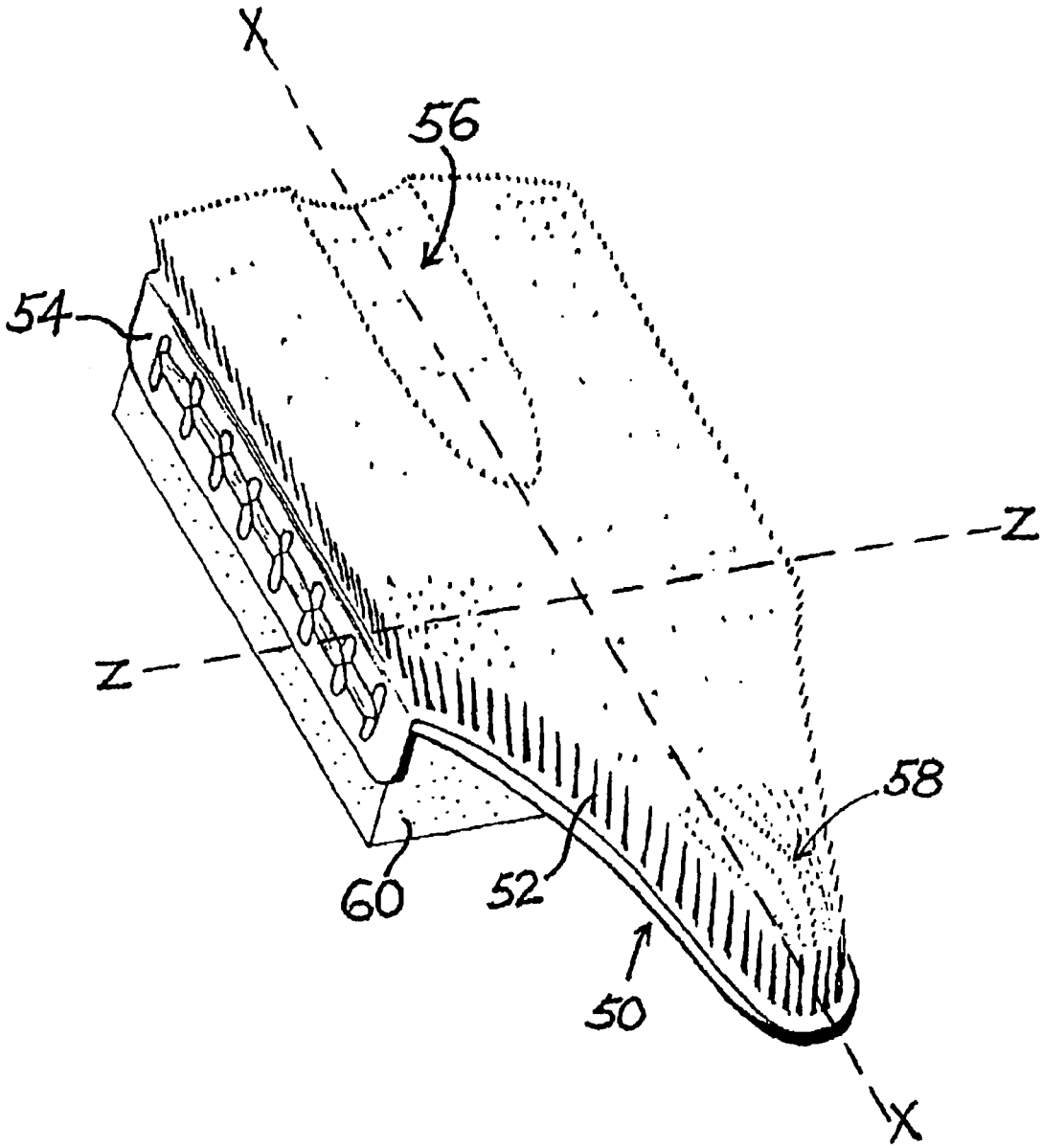
FIG. 3A shows the perspective view of a brush according to the preferred embodiment of the present invention.
Figure 3B:
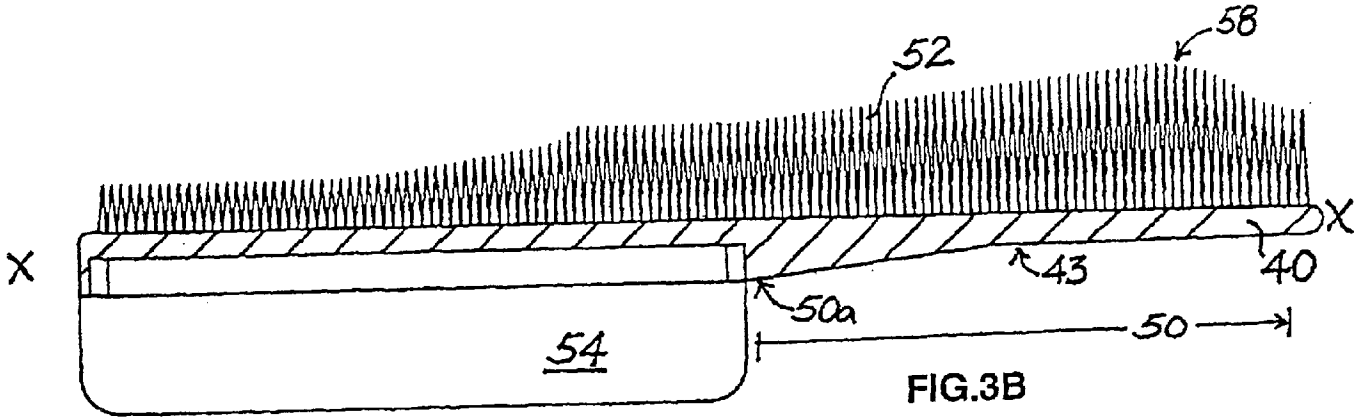
FIGS. 3B–3G is the same brush as FIG. 3A, but without the sponge, showing the longitudinal cross-sectional view along line X-X (FIG. 3B); the side view (FIG. 3C); traverse cross-sectional view along line Z-Z and viewed from the front edge (FIG. 3D); traverse cross-sectional view along line Z-Z and viewed from the back edge (FIG. 3E); bottom plan view (FIG. 3F); and bottom plan view (FIG. 3G).
Figure 3C:
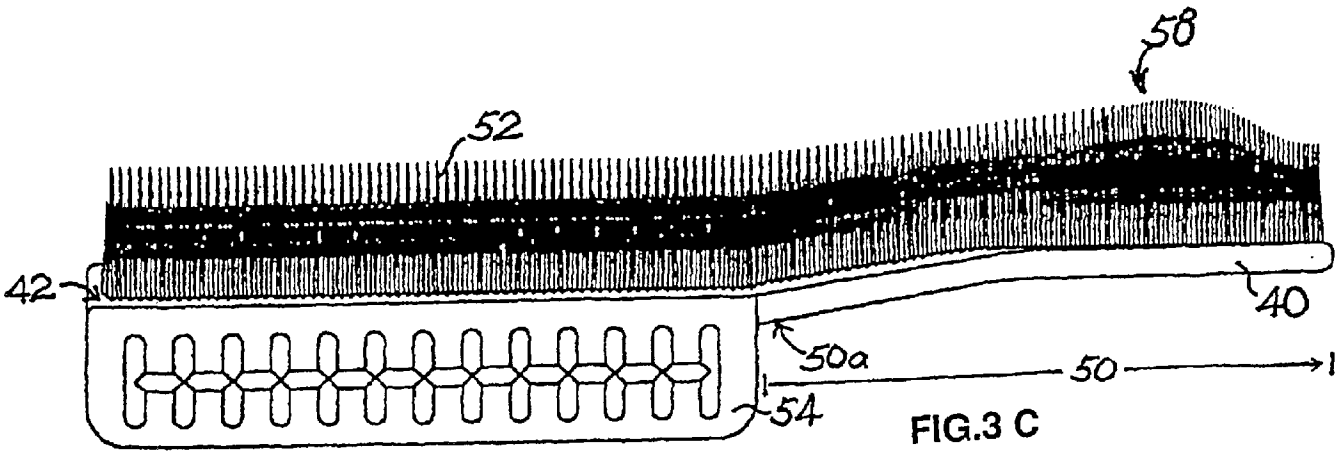
Figure 3E:
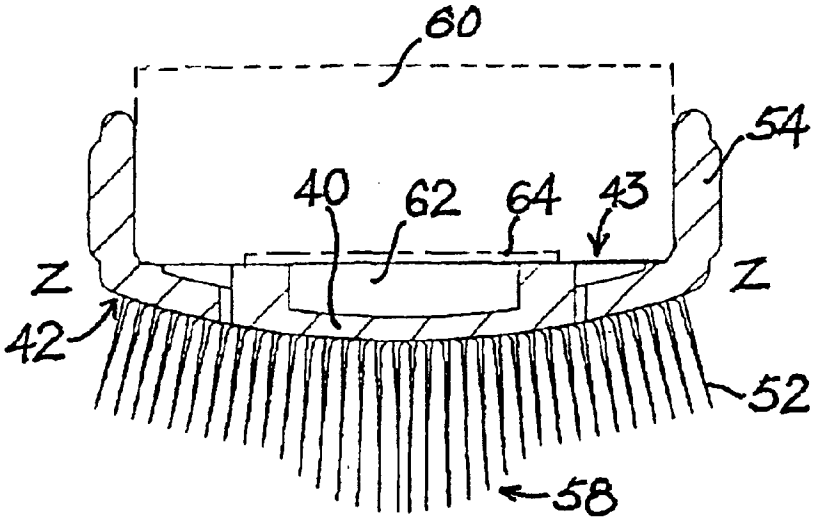
Figure 3D:
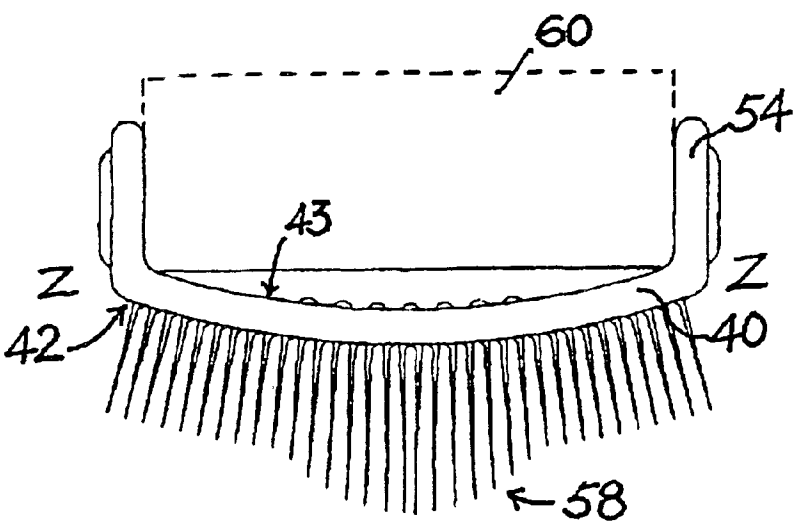
Figure 3G:
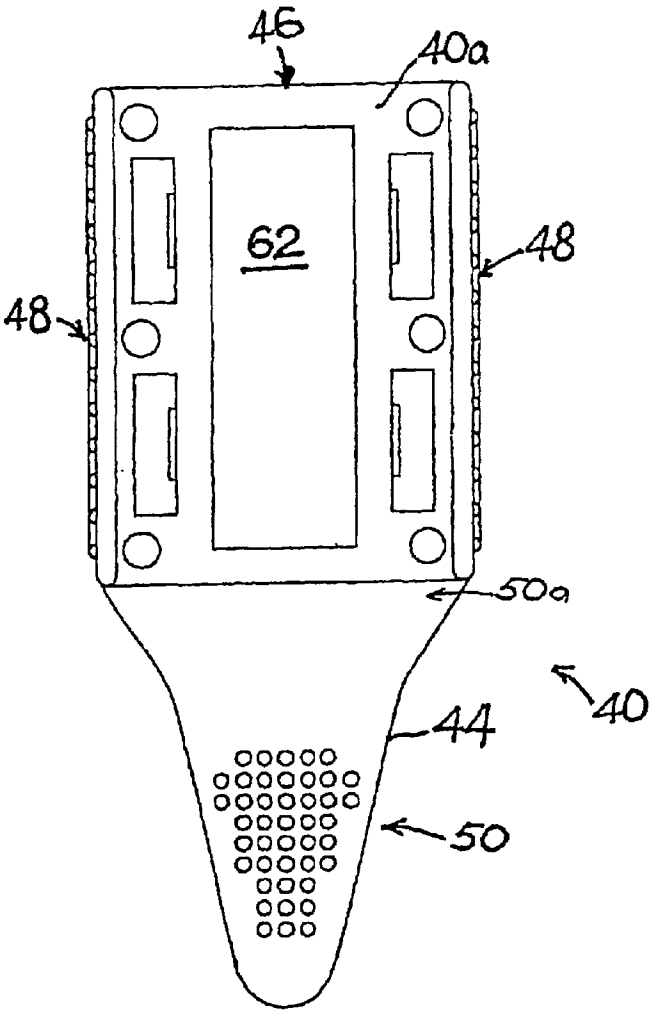
Figure 3F:
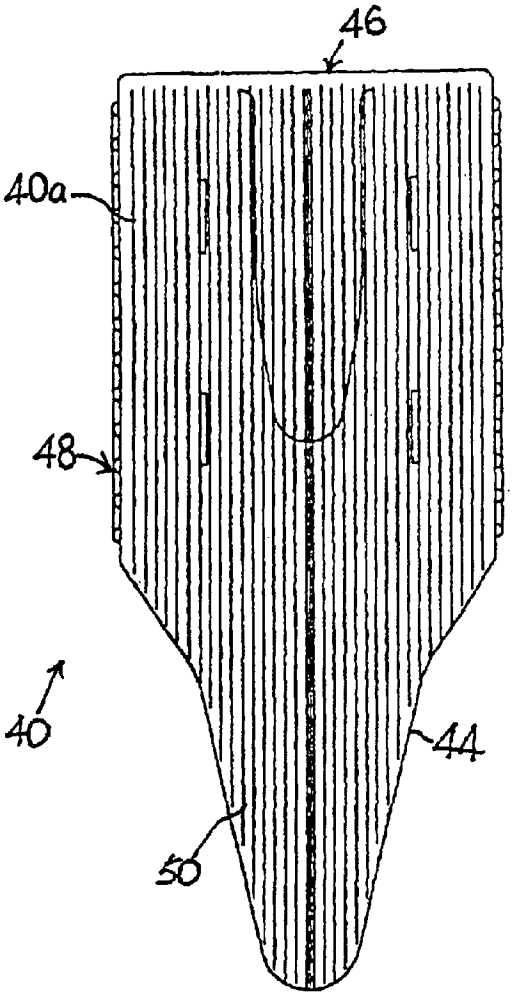

Referring now to FIGS. 3A to 3G, the preferred embodiment of the present invention contains a flat base 40 having a first side 42 and a second side 43 and defined by a front edge 44, a back edge 46 and two lateral edges 48 therebetween. The front edge 44 extends from the main body of the base (main body is the area approximately defined by the region between the two lateral edges 48, and is rectangular in shape in the specific embodiment shown in FIGS. 3A to 3G) and forms a narrow elongated scrubbing head 50 with a rounded distal tip. The proximal end 50*a* of the scrubbing head 50 is connected to main body 40*a*.

Closely spaced bristles 52 extend from the first side 42 to form a brush. The lateral edges are preferably formed into an enlarged gripping surface 54 for the convenience of the user. The base is most preferably formed into a convex or outwardly curved surface, with the ends of the bristles forming a profile of the equivalent convex curvature to provide good contact with the hand during the scrubbing process. The convex profile formed the bristle ends is optimally designed for effective cleaning, and therefore the squeezing of the brush by the user to form addition curvature on the brush is discouraged preferably by making the base rigid.

Additional features in the preferred embodiment include a depression 56 formed on the profile of the bristle ends on the main body The depression is preferably of a shallow rod-shape to conform to the general shape of finger for effective cleaning of the sides of the fingers. The bristles at the distal end of the scrubbing head are preferably longer than those in the other areas of the brush, and form a small dome 58 that can be used for scrub crevices and folds.

An absorbent material, such as a sponge (as shown in 60 by the dotted lines in FIGS. 3D and 3E), is preferably attached to the second side of the base, so that cleaning agents may be effectively administered to the skin. Cleaning agents include, but are not limited to, chlorhexidine gluconate, providine iodine and isopropyl alcohol. The second side 43 of the base is preferably also provided with at least one recess to act as a reservoir for retaining the cleaning agent. An elongated plastic tape may be mounted onto the second side at position 64 with adhesives around recess 62 to seal the cleaning agent therein. In the most preferred embodiment, one half of the tape is mounted onto the area around the recess by adhesives for sealing purposes, and the other half of the tape is loose and non-adhesive, and folded backwards above the mounted half such that the loose end extends out from the back edge of the base as a tab. In this way, the user can pull at the tab and remove the entire tape when he wants to release the cleaning agent. Thereafter, if the absorbent material is present on the second side, a few pumping action thereon will cause the absorbent material to be impregnated with the cleaning agent for effective cleaning. Using this reservoir and removable tape design, sponges can be used as the absorbent material without reducing the shelf life of the brush. This is because the cleaning agents is stored in a sealed reservoir away from the sponge until the tape is pulled away by the user, and thus would be prevented from reacting with and weakening the sponge during storage.

As a non-limiting example of a brush according to the present invention, the base and the bristles are preferably produced of a soft plastic material such as low density polyethylene, and are molded as a single piece. One effective shape for the bristles is a half-solid pyramid structure having an isosceles triangle base with the longer side of 1 mm and the tip of the bristles extending vertically up from between 5–15 mm. Generally, the length of the bristles are 10 mm, with progressive reduction in length towards the back edge of the brush, and reducing to 5 mm at the center rear to cater for the index fingers. Towards the front edge of the brush, the length of the bristles increases until it reaches 15 mm towards the tip of the brush.

During the scrubbing process, the index finger of the hand that holds the brush should be placed on the tip of the scrubbing head to increase the rigidity while scrubbing. The other fingers are then used to grip the gripping surface provided at the lateral edges.

While the present invention has been described particularly with references to the aforementioned figures, it should be understood that the figures are for illustration only and should not be taken as limitation on the invention. It is contemplated that many changes and modifications may be made by one of ordinary skill in the art without departing from the spirit and the scope of the invention described. For example, the dimensions given in the above description and the exact shapes shown in the drawings are examples only, and may be modified according to general market needs.

What is claimed is:

1. A scrub brush comprising:

a base having a first and second opposing sides with a front edge, a back edge and two lateral edges therebetween;

said first side covered with a plurality of bristles extending therefrom;

said plurality of bristles each ending in a tip;

said front edge further formed into an elongated end pointed extension such that said plurality of bristles positioned within said extension forms a narrow scrubbing head;

said plurality of bristles between said lateral edges form a main body of bristles;

said tips of said main body of bristles forming a surface profile;

said surface profile generally having a convex shape and further containing a rod-shaped depression thereon; and said depression approximately of the shape of one side of a finger such that scrubbing of fingers is facilitated.

2. A brush according to claim 1 wherein a reservoir is provided in said base;

said reservoir for storing a cleaning agent and having a removal cover such that removal of said cover releases said cleaning agent.

3. A brush according to claim 1 further comprising an absorbent element attached to said second side.

4. A brush according to claim 3 wherein said second side having at least one recess;

said recess for retaining a cleaning agent;

said base further comprising a tape attached with adhesive on said second side for sealing said cleaning agent within said recess;

said tape further connected to a tab extending out of said base; and said cleaning agent capable of being released into said absorbent material by detaching said tape by pulling said tab.

5. A brush according to claim 3 wherein said absorbent element is a sponge.

6. A brush according to claim 1 wherein said first side of said base has a convex profile.

7. A brush according to claim 1 wherein said base is made of a rigid plastic.

8. A brush according to claim 1 wherein said narrow scrubbing head comprises a proximal end and a distal end;

said proximal end joined to said lateral sides; and said distal end having a dome shaped surface profile.

9. A scrub brush comprising:

a base having a first and second opposing sides with a front edge, a back edge, two lateral edges therebetween said front edge and said back edge, and a reservoir in said base;

said first side covered with a plurality of bristles extending therefrom;

said plurality of bristles each ending in a tip; and said reservoir for storing a cleaning agent and having a removable cover such that removal of said removable cover releases said cleaning agent; wherein said front edge further formed into an elongated and pointed extension such that said plurality of bristles positioned within said extension forms a narrow scrubbing head;

further wherein said plurality of bristles between said lateral edges form a main body of bristles; said tips of said main body of bristles forming a surface profile; said surface profile generally having a convex shape and further containing a rod-shaped depression thereon; and said depression approximately of the shape of one side of the finger such that scrubbing of fingers is facilitated.

10. A brush according to claim 9 further comprising an absorbent element attached to said second side.

11. A brush according to claim 9 wherein said reservoir comprises at least one recess;

said recess formed on said second side.

12. A brush according to claim 11 wherein said removable cover comprises at least one tape attached with adhesive on said second side for sealing said cleaning agent within said recess;

said tape further connected to a tab extending out of said base; and said cleaning agent capable of being released into said absorbent element by detaching said tape by pulling said tab.

13. A brush according to claim 9 wherein said absorbent element is a sponge.

14. A brush according to claim 9 wherein said first side of said base has a convex profile.

15. A brush according to claim 9 wherein said base is made of a rigid plastic.

16. A brush according to claim 9 wherein said narrow scrubbing head comprises a proximal end and a distal end;

said proximal end joined to said lateral sides; and said distal end having a dome shaped surface profile.

* * * * *